US006484813B2

(12) United States Patent
Tapio et al.

(10) Patent No.: US 6,484,813 B2
(45) Date of Patent: Nov. 26, 2002

(54) BULLDOZER ATTACHMENT TO FACILITATE GRADING

(75) Inventors: John A. Tapio, Brush Prairie, WA (US); Nels D. Tapio, Brush Prairie, WA (US); Kyle J. Tapio, Brush Prairie, WA (US)

(73) Assignee: Tapio Construction, Inc., Vancouver, WA (US)

( * ) Notice: Subject to any disclaimer, the term of this patent is extended or adjusted under 35 U.S.C. 154(b) by 0 days.

(21) Appl. No.: 09/836,048

(22) Filed: Apr. 16, 2001

(65) Prior Publication Data

US 2002/0148622 A1 Oct. 17, 2002

(51) Int. Cl.[7] ..... E02F 3/80
(52) U.S. Cl. ..... 172/701.1; 37/903
(58) Field of Search ..... 172/701.1, 810, 172/811, 816, 685, 681, 692, 693; 37/232, 233, 266, 219, 903

(56) References Cited

U.S. PATENT DOCUMENTS

| | | | | | |
|---|---|---|---|---|---|
| 2,594,727 | A | | 4/1952 | Burggren | |
| 3,429,381 | A | | 2/1969 | Launder et al. | 172/802 |
| 3,765,109 | A | * | 10/1973 | Daviduke | 37/403 |
| 3,803,733 | A | * | 4/1974 | Ramsey | 172/815 |
| 3,866,773 | A | * | 2/1975 | Koch | 414/152 |
| 4,009,529 | A | | 3/1977 | Johnson | 37/117.5 |
| 4,049,060 | A | * | 9/1977 | Hoke | 172/19 |
| 4,068,726 | A | | 1/1978 | Heitman | 172/802 |
| 4,073,077 | A | | 2/1978 | Essel et al. | 37/50 |
| 4,079,791 | A | | 3/1978 | Yoder et al. | 172/802 |
| 4,189,854 | A | * | 2/1980 | Hayes | 37/466 |
| 4,223,461 | A | | 9/1980 | Tackitt | 37/105 |
| RE31,045 | E | | 10/1982 | Essel et al. | 37/281 |
| 4,360,980 | A | | 11/1982 | Jarvis | 37/117.5 |
| 4,369,847 | A | | 1/1983 | Mizunzma | 172/815 |
| 4,552,226 | A | * | 11/1985 | Platter | 172/815 |
| 4,667,426 | A | | 5/1987 | Howard et al. | 37/232 |
| 5,191,729 | A | * | 3/1993 | Verseef | 37/232 |
| 5,343,959 | A | | 9/1994 | Frisbee et al. | 172/701.3 |
| 5,392,538 | A | | 2/1995 | Geerligs et al. | 37/268 |
| 5,437,113 | A | * | 8/1995 | Jones | 37/233 |
| 5,603,172 | A | * | 2/1997 | Maher | 37/233 |
| 5,638,618 | A | | 6/1997 | Niemela et al. | 37/281 |
| 6,088,938 | A | | 7/2000 | Logan | 37/468 |
| 6,112,438 | A | * | 9/2000 | Weagley | 172/393 |
| 6,125,559 | A | * | 10/2000 | Mullenhour | 37/232 |

* cited by examiner

*Primary Examiner*—Robert E. Pezzuto
(74) *Attorney, Agent, or Firm*—Law Office of Timothy E. Siegel; Timothy E. Siegel

(57) ABSTRACT

A fine grading attachment, adapted to be affixed to a bulldozer and comprising an elongate body having fasteners, adapted to affix the attachment to a bulldozer in a predetermined orientation. In this orientation the length of the elongate body extends along and in front of the bottom of the bulldozer and the front face of the attachment is disposed to be vertical or to slope forwardly as it extends from bottom to top when the bulldozer is positioned so that the attachment contacts the soil.

6 Claims, 3 Drawing Sheets

BULLDOZER ATTACHMENT TO FACILITATE GRADING

BACKGROUND OF THE INVENTION

The present invention is a bulldozer attachment. More specifically the present invention is a bulldozer blade attachment designed to facilitate the fine grading of a parcel of land.

The process of using a tractor equipped with a bulldozer blade to grade a parcel of land is a common chore in the construction trade, typically necessary to produce a building or a paved lot. Although road graders are available, these devices are cumbersome for the grading of a parcel of land with boundaries in two dimensions, as opposed to a road that extends indefinitely in its longitudinal dimension. Although a power roller may be used to finish the job of compacting, this is not always practical.

Typically, the grading process is performed by driving the bulldozer back and forth across a first strip of land in the parcel until that strip is relatively flat and compacted. As the bulldozer is driven forward any high ground is scooped into the pile of earth that is pushed along in front of the bulldozer. In turn, this pile serves to fill in troughs as it travels forward. When this pile is large, the process takes place easily. But during fine grading, toward the end of the process, the smaller dirt pile may be largely supported by the bulldozer blade and, may not drop off to fill in depressions as easily. On the backstroke, a similar process takes place, with the backside of the bulldozer blade also performing some compaction. The bulldozer then moves to a second, adjoining strip of land in the parcel and smoothes and compacts the earth there, taking care to make it level with the land in the first strip. This process continues until the parcel is completed.

Hampering this process is the fact that the backside of a bulldozer blade is not specifically designed to compact earth. Nor is a bulldozer blade well adapted to perform fine grading on the forward stroke. Because the bulldozer is too sharp to be rested on the earth, its position is set by the earth under the tractor treads, which determines the tractor position, and operator intervention. A smoothing device that could rest on the soil would be far more responsive to the local soil level, which would be beneficial in fine grading.

An additional problem is encountered when performing grading work near a building or foundation. A typical tractor used to push a bulldozer blade may weigh several tons. The vibrations caused by the movement of this large weight may damage nearby underground structures. If the bulldozer is called upon to grade a land parcel that abuts a building or foundation, it may be quite difficult to perform this work without causing some damage.

SUMMARY

In a first separate aspect, the present invention is a fine grading attachment, adapted to be affixed to a bulldozer blade and comprising an elongate body having fasteners, adapted to affix the attachment to a bulldozer blade in a predetermined orientation. In this orientation the length of the elongate body extends along and in front of the bottom of the bulldozer blade and the front face of the attachment is disposed to be vertical or to slope forwardly as it extends from bottom to top when the bulldozer blade is positioned so that the attachment contacts the soil.

In a second separate aspect, the present invention is a method of grading a first and a second parcel of land. The method comprises providing a tractor equipped with a bulldozer blade, that in turn bears a collapsible fine grading attachment placed in its extended state, and using the bulldozer blade to grade the first parcel of land. Then the fine grading attachment is collapsed and the tractor is driven onto a road conveyance, which is driven to the second parcel of land. At that point the fine grading attachment is expanded and the bulldozer blade is used to grade the second parcel of land.

The foregoing and other objectives, features and advantages of the invention will be more readily understood upon consideration of the following detailed description of the preferred embodiment(s), taken in conjunction with the accompanying drawings.

DETAILED DESCRIPTION OF THE PREFERRED EMBODIMENT

Figure 1:
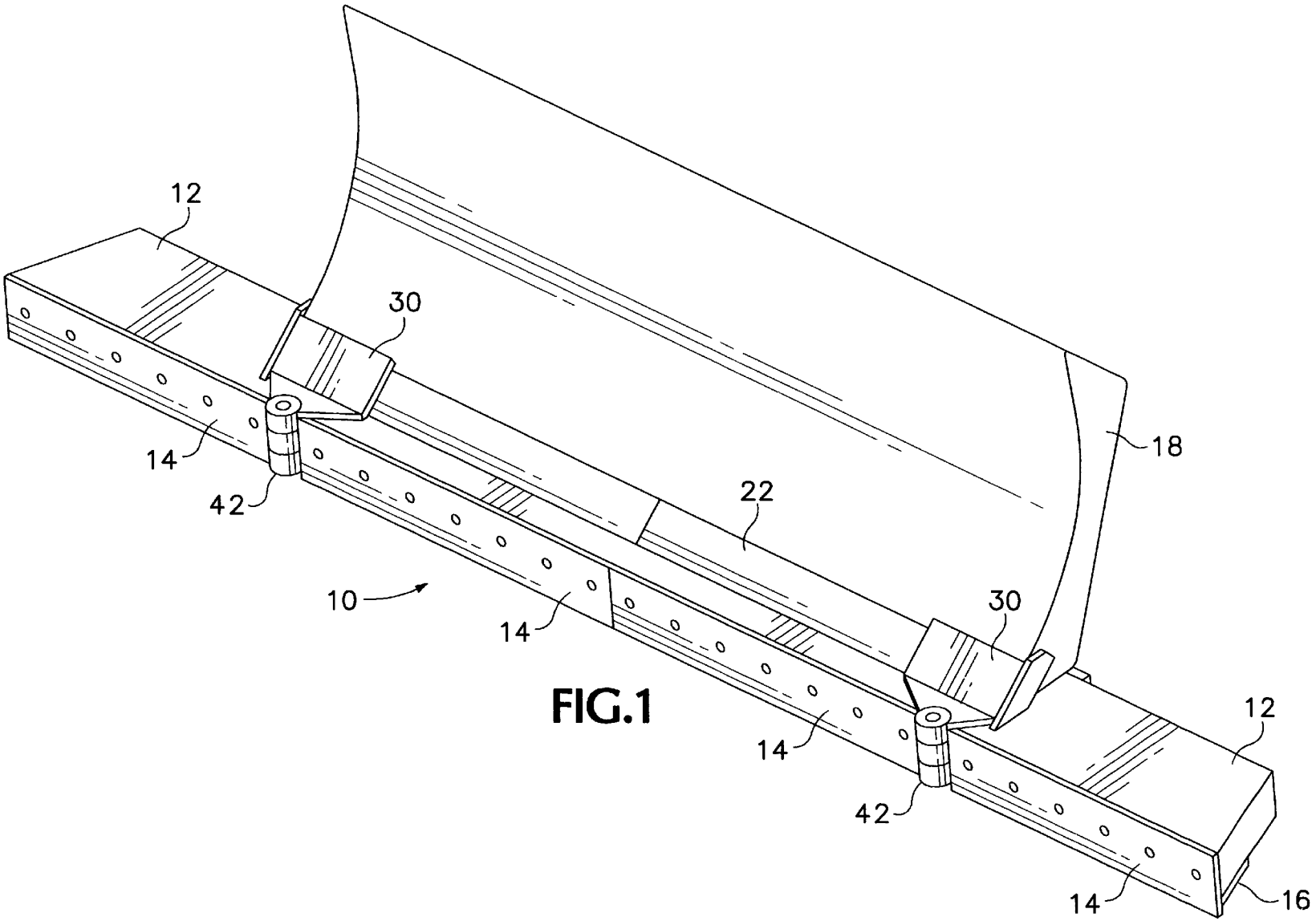
FIG. 1 is a front perspective view of the attachment of the present invention, in its extended state, attached to a bulldozer blade.
Figure 2:
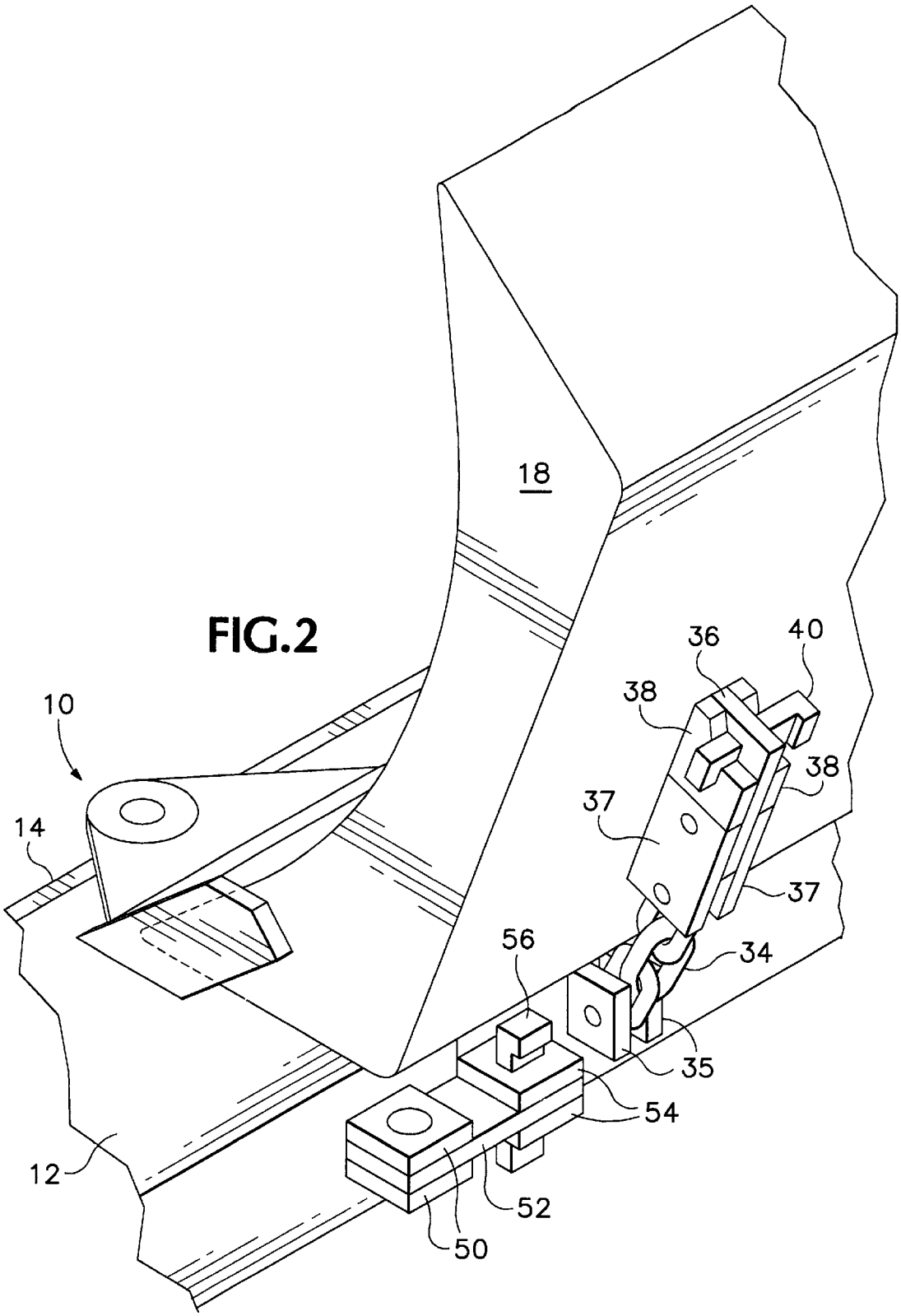
FIG. 2 is a rear perspective view of the attachment of the present invention, in its extended state, attached to a bulldozer blade.
Figure 3:
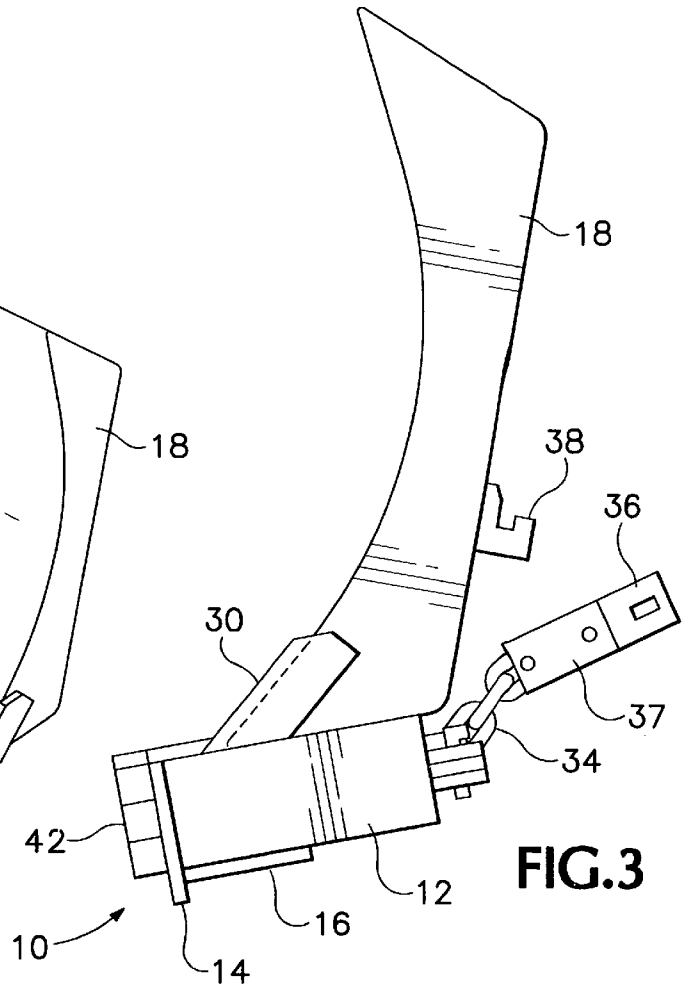
FIG. 3 is a side view of the attachment of the present invention, in its extended state, attached to a bulldozer blade.
Figure 4:
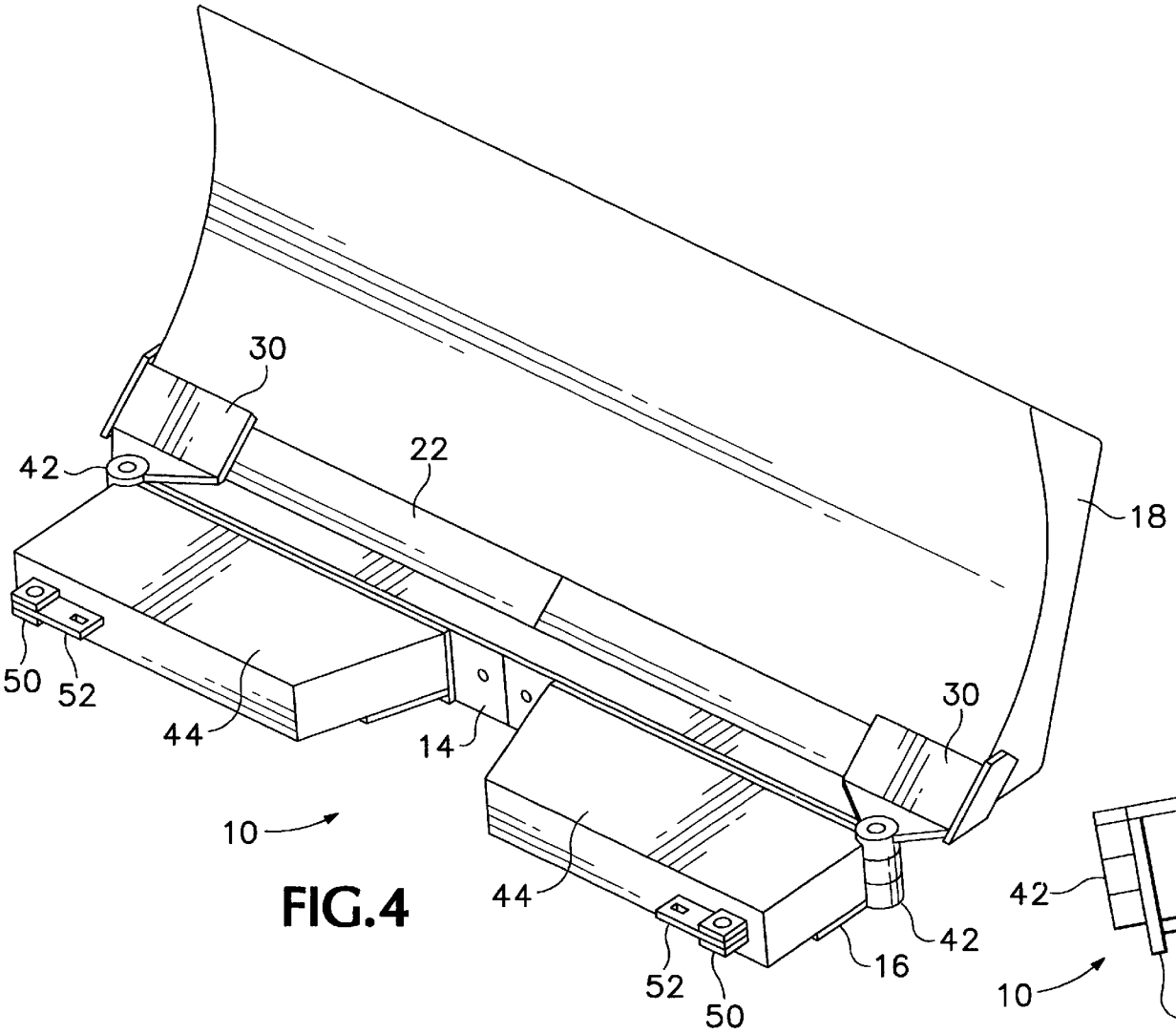
FIG. 4 is a front perspective view of the attachment of the present invention, in its collapsed state, attached to a bulldozer.

Referring to FIG. 1, the present invention is a bulldozer attachment 10, in the form of an elongate body, for performing fine grading. An elongate central support 12 in the form of a rectangular steel tube, supports a replaceable front cutting edge plate 14 and a bottom wear plate 16. As those familiar with the size of a bulldozer blade will recognize, the attachment 10 extends outwardly by approximately a meter (3.28 ft) on either side of the bulldozer blade 18.

Significantly, when the bulldozer blade 18 is lowered so that attachment 10 contacts the earth, the front surface of front cutting edge plate 14 slopes forwardly from bottom to top. This is important because, as a result, this surface (or face) cannot support any dirt as can a bulldozer, which slopes backwardly from bottom to top when positioned at the soil surface. Accordingly, the soil that is pushed in front of cutting edge plate 14 on the bulldozer's forward sweep, not being in any way supported by attachment 10 will naturally fall into any depression encountered. Soil that is partially supported by a bulldozer does not as easily fall into the encountered depressions as the bulldozer is driven quickly forward.

In addition, bottom wear plate 16 slopes backwardly more sharply than cutting edge plate 14 slopes forwardly. Accordingly, bottom wear plate 16 is well adapted to compact earth on the back sweep of the bulldozer. Although the backside of a bulldozer also slopes backwardly, it is far more irregularly shaped because of the bolts that affix a replaceable blade 22 to the bulldozer blade 18 and the bolt wells that accommodate these bolts.

Also, the greater length of attachment 10, relative to the width of a bulldozer reduces the number of sweeps necessary for grading a parcel of land. In the Background section, it is noted that a parcel of land is generally divided into strips with the dozer operator driving backward and forward to level a first strip before proceeding to a second, abutting strip. By increasing the strip width, the labor is decreased not just because the number of strips is decreased, but also because the difficult process of ensuring that each strip is at the same level as its neighbors must be performed fewer times.

In addition, the attachment 10 permits land close to underground structures, such as building foundations, to be leveled without bringing the weight of the bulldozer as close to the structure as would otherwise be necessary.

Attachment 10 is retained on dozer blade 18 by a set of brackets, including front brackets 30 into which dozer blade 22 fits. In addition a chain 34 attached to attachment 10 by fixture 35 terminates in a fastening structure 36 having an aperture and a pair of shoulder pieces 37. A double U-bracket 38 is welded to the back of dozer 18 and shoulder pieces 37 are placed to abut the undersides of U-bracket 38. A pin is place through the aperture of fastening structure 36 so that it fits within the U of U-bracket 38, thereby positively retaining structure 36.

For ease in transportation, attachment 10 is foldable. A pair of hinges 42 permit a pair of wing pieces 44 to be swung forwardly and inwardly to place attachment 10 in a compact state. The advantage of this state is that it permits a tractor, equipped with bulldozer that has an attachment 10 affixed to it, to be driven onto a truck or a trailer for ready transportation to another job site. As attachment 10 is far to heavy to be handled by even a pair of operators, detaching it from bulldozer blade 18 and separately stowing it onto a trailer would be impossible or impractical without a fork lift.

For either wing piece 44 an apertured plate 52 rotatable about a hinge 50 swings to fit between a pair of similarly apertured plates 54 where it is held in place by a pin 56. In this condition of being held together, the body portions of wing pieces 44 and of the central portion of central support 12 form the single central support 12.

Central support 12 is made of 95 mm (⅜") thick steel rectangular tubing. Front cutting edge plate 14 and bottom wear plate 16 are both made of 1.58 cm (⅝") thick hardened steel. The total length of attachment 10 is 4.26 meters (14 ft) with each wing piece 44 being 0.87 meters long (2.5 ft), it weighs approximately one metric ton. All of these figures are for a single specific preferred embodiment. Other preferred embodiments, adapted for use with other sized bulldozers, would have differing dimensions and weight.

The terms and expressions that have been employed in the foregoing specification are used as terms of description and not of limitation. There is no intention, in the use of such terms and expressions, of excluding equivalents of the features shown and described or portions thereof, it being recognized that the scope of the invention is defined and limited only by the claims which follow.

What is claimed is:

1. A fine grading attachment, adapted to be affixed to a bulldozer blade having a bottom, said attachment comprising:

(a) an elongate body having a front face and a rear face;

(b) fasteners, adapted to affix said attachment to a bulldozer blade in a first along and in front of said bottom of said bulldozer blade and so that when said bulldozer blade is positioned so that said attachment contacts the soil, said front face is fixed in orientation relative to said bulldozer blade so that said front face slopes rearward as if extends from top to bottom and said rear face slopes forward from top to bottom so that said front face and said rear face substantially meet at their respective bottoms and said front face is oriented so as to push dirt forward and downward as the bulldozer blade is moved forward and said rear face is oriented so as to push dirt rearward and downward as the bulldozer blade is moved rearward.

2. The attachment of claim 1, wherein said elongate body is formed of a central support and a front cutting edge plate rigidly but removeably affixed to said elongate body provides said front face.

3. The attachment of claim 2, wherein said front plate is made of hardened wear resistant steel.

4. The attachment of claim 1, wherein said elongate body is extensible in length.

5. The attachment of claim 1, wherein said elongate body is hinged and foldable, so that it may be placed in a first, compacted in length state for transportation and in a second expanded in length state for fine grading use.

6. The attachment of claim 2, wherein a bottom wear plate is rigidly affixed to said central support in a manner that permits its removal and replacement.

* * * * *

UNITED STATES PATENT AND TRADEMARK OFFICE

CERTIFICATE OF CORRECTION

PATENT NO. : 6,484,813 B2 
DATED : November 26, 2002
INVENTOR(S) : Tapio et al.

It is certified that error appears in the above-identified patent and that said Letters Patent is hereby corrected as shown below:

Column 4,
Line 21, change "if" to -- it --.

Signed and Sealed this

Twenty-fourth Day of June, 2003

JAMES E. ROGAN
*Director of the United States Patent and Trademark Office*